United States Patent [19]

Brandis

[11] 4,078,369

[45] Mar. 14, 1978

[54] MAINTAINING SUPPLY OF FIBER MATERIAL FOR TEXTILE SPINNING MACHINES

[75] Inventor: Curt Brandis, Bremen-Borgfeld, Germany

[73] Assignee: Fried. Krupp Gesellschaft mit beschrankter Haftung, Essen, Germany

[21] Appl. No.: 746,320

[22] Filed: Dec. 1, 1976

[30] Foreign Application Priority Data

Dec. 6, 1975 Germany ..... 2554915

[51] Int. Cl.[2] ..... D01H 13/24; D01G 31/00

[52] U.S. Cl. ..... 57/34 R; 57/81; 57/156

[58] Field of Search ..... 57/34 R, 78, 81, 84, 57/58.89–58.95, 80, 83, 86, 156; 19/.2, .25; 226/11

[56] References Cited

U.S. PATENT DOCUMENTS

| | | | |
|---|---|---|---|
| 3,163,977 | 1/1965 | Weiss | 57/81 X |
| 3,438,189 | 4/1969 | Gasser et al. | 57/81 |
| 3,760,576 | 9/1973 | Chatelier et al. | 57/34 R |
| 3,854,274 | 12/1974 | Bartling | 57/34 R |
| 3,879,926 | 4/1975 | Bartling et al. | 57/34 R X |
| 3,882,663 | 5/1975 | Soukup | 57/34 R |
| 3,955,243 | 5/1976 | Binder | 19/.2 |

FOREIGN PATENT DOCUMENTS

| | | | |
|---|---|---|---|
| 888,819 | 7/1953 | Germany | 19/.2 |

*Primary Examiner*—Donald Watkins
*Attorney, Agent, or Firm*—Spencer & Kaye

[57] ABSTRACT

In the processing of a band of fiber material at a plurality of processing locations in a textile machine which operates while periodically being unattended and receives the fiber material band to be processed from supply containers, a sufficient supply of fiber material to the machine is assured by automatically monitoring the quantity of fiber material in each container, and producing an output signal when the monitoring indicates that the quantity of fiber material in a container has reached a lower limit value.

16 Claims, 8 Drawing Figures

MAINTAINING SUPPLY OF FIBER MATERIAL FOR TEXTILE SPINNING MACHINES

BACKGROUND OF THE INVENTION

The present invention relates to maintenance of a sufficient supply of fibers for spinning machines having a plurality of processing locations, particularly for machines which operate periodically while unattended and which receive a band of fiber material, or roving, to be processed from supply containers. The invention is more particularly directed to open-end spinning machines containing apparatus for automatic replacement of bobbins and automatic correction of yarn breaks.

Textile machines, particularly open-end spinning machines, are presently automated by the provision of additional devices, for example, devices for correcting breaks in the yarn and for replacing bobbins, so that they can operate unattended during one or a plurality of shifts.

Their ability to operate unattended is assured only, however, if the supply of fiber material is controlled so that during the unattended shifts it will not be necessary to replace supply containers, i.e. the fill level of the supply containers must be checked at the beginning of an unattended work section and containers which do not contain a sufficient fill level must then be replaced, if necessary.

SUMMARY OF THE INVENTION

It is an object of the present invention to assure a sufficient supply of fiber material so that the maintaining of an adequate supply of fiber materials will be facilitated in more or less automatic textile machines and the need for attending personnel is reduced.

This and other objects of the invention are accomplished by an operating method in which the extent to which each supply container is filled is continuously determined by means of automatically operating monitoring devices and when a lower limit value is reached, an indication signal is produced.

The present invention is thus based on the concept of continuously monitoring, by means of suitable devices, the degree of fill of the supply containers holding the band-shaped fiber material to be processed. If the fill level in one of the supply containers falls below a certain value, this is indicated by the production of a signal so that the empty supply container can be replaced by a full supply container.

According to a particularly simple embodiment of the method according to the invention, the fill level is determined by measuring the length of the fiber material removed from each supply container. Preferably the fill level can also be monitored by measuring the reduction in gross weight which occurs during the removal of fiber material from a supply container.

According to a further suitable embodiment of the method, the fill level of each supply container is determined by measuring the top of the mass of fiber material in each container.

Apparatus according to the invention for use with textile machines, particularly open-end spinning machines having a plurality of processing locations and supply containers connected to each, includes at each location of a supply container, a monitoring device which is in communication, through the intermediary of an actual value/limit value comparison unit in which the limit value is adjustable, with an indicator device.

The monitoring device may be designed as a length measuring unit and be provided with a counter whose sensor is acted upon by the longitudinal movement of the fiber material into the spinning unit. With open-end spinning machines for example, the sensor of the counter may be coupled to the intake rollers associated with each spinning location. When the supply containers assigned to the individual spinning locations are exchanged, the counter is reset to the starting value "zero"; thus the counter indicates at any time the length of the fiber material already removed from the supply container.

According to another advantageous embodiment of the apparatus, the monitoring device is designed as a weighing unit provided with a variable height weighing platform on which its supply container is disposed.

The weighing platform preferably has associated with it a variable height controlled switch which is part of the indicator unit. The change in the weight of the supply container upon removal of fiber material results in a change of the height level of the weighing platform which, when a settable limit value is reached, actuates a switching pulse and thus causes the indicator unit to operate.

The apparatus may also be designed so that each supply container has associated to it an ultrasonic transmitting/receiving unit, which is placed above the surface of the material in the container. The ultrasonic unit evaluates the return signal reflected from the target object, i.e. the surface of the fiber material in the container, and when a maximum distance from the target object has been reached, which corresponds to a certain fill level in the supply container, it causes the indicator unit to operate.

Instead of an ultrasonic unit, the fill level in the supply container can also be monitored by monitoring devices which operate according to the magnetic-elastic principle, or by inductive sensors.

In certain cases, particularly when the fiber material is not very bulky, the device may be designed so that the fill level of the supply containers is determined directly, for example with the use of a sensor, which mechanically scans the surface of the contents of the container.

According to a further preferred embodiment of the present invention, a transmitting unit emitting radioactive radiation is disposed at one side of the contents of each supply container and on the side opposite thereto a receiver is disposed which feeds an indication of the radiation intensity, as it varies in dependence on the fill level, as an actual value signal to a comparison unit.

Apparatus according to the invention is advantageously designed so that each monitoring device has its own associated indicator unit. It is also possible, however, to combine the monitoring devices into groups, for example, with each group having a common indicator unit.

DESCRIPTION OF THE PREFERRED EMBODIMENTS

Figure 1:
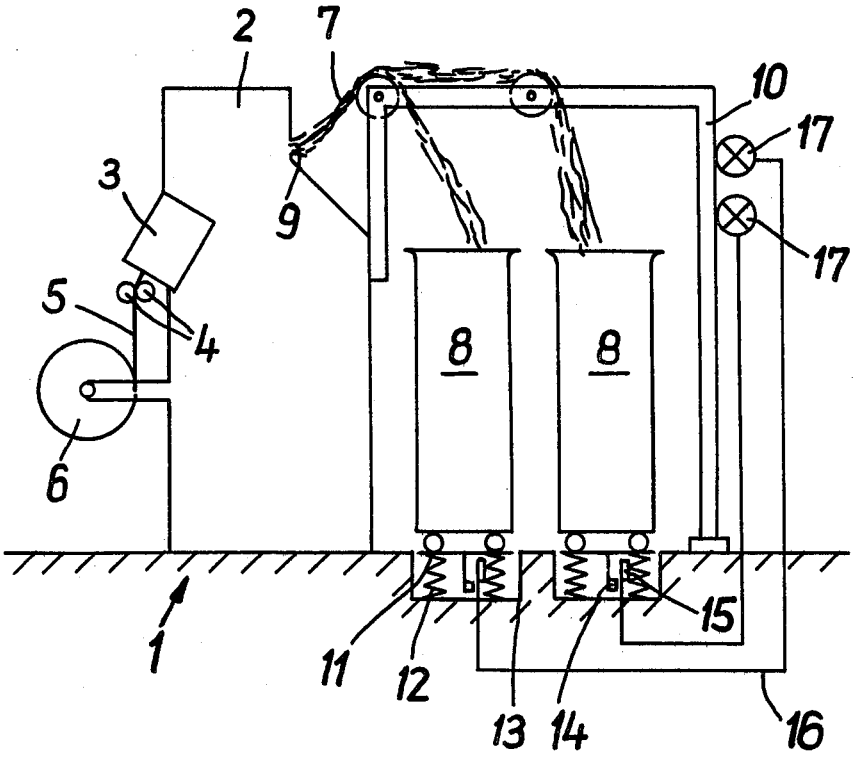
FIG. 1 is a simplified pictorial, elevational view of an open-end spinning machine with supply containers arranged on a weighing unit and a switch associated with the weighing platform according to one embodiment of the invention.

The apparatus shown in FIG. 1 includes an open-end spinning machine 1 whose basic components include a series of open-end spinning units 3 disposed side-by-side, perpendicular to the plane of the Figure, in a machine frame 2, each unit 3 having associated delivery rollers 4 arranged to supply the finished yarn 5 from its associated unit to a respective winding device or bobbin 6.

Fiber material 7 which is present in band form and is to be processed in the spinning machine is removed from canisters 8, each spinning location having its own canister. The fiber material 7 enters through an inlet opening 9 into the spinning machine, is there separated by means of one or a plurality of break-up rollers and then fed to a spinning rotor in whose fiber collecting trough the yarn 5 is formed.

The break-up roller or rollers, the spinning rotor and the feed roller moving the fiber material 7 are not shown in the general arrangement for reasons of clarity. Embodiments thereof are well-known in the art and any known arrangement can be used.

In the embodiment shown in FIG. 1 the canisters 8 which serve as the supply containers are arranged in two rows within a stand 10, each row extending perpendicular to the plan of the Figure. Each canister rests on a respective weighing platform 11 which is supported by spring devices 12 and a base surface 13. At the lower surface 110 of each weighing platform 11 there are fastened sleeves 111 slidable on sleeves 131 fastened to the base surface 13, so the weighing platforms 11 are movable in the vertical direction. Below each weighing platform 11, there is fastened a magnetic switch 15 to a holder 135 fixed to the base surface 13. The magnetic switch 15 being part of a switching circuit 16 for a signal light 17, is controlled by a permanent magnet 14. The permanent magnet 14 is fastened at the lower end of a holder 114 carried by the platform 11. Both the magnet 14 and the holder 114 are adjustable in height. The permanent magnet 14 is advantageously adjusted so, that when the fill level of a canister 8 has reached a lower limit value it is at the same height as the magnetic switch 15.

The removal of fiber material 7 from each canister 8 continuously reduces the weight acting on the associated weighing platform 11 and thus the height of the weighing platform is changed.

As soon as the fill level of a canister 8 has reached a lower limit value and the permanent magnet 14 and the magnetic switch 15 are at the same height, the magnet 14 attracts the core 151 of the switching element 150 against the force of a pressure spring 153 within the housing of the magnetic switch 15. So the contact bridge 152 of the switching element 150 is approached to the contacts 154 and 155 and the switching circuit 16, which until this time has been interrupted, is closed so that the associated signal light 17 lights up. The operator of the spinning machine can therefore determine at once at which point in time and at which location of the spinning machine it will be necessary to change canisters.

Figure 2:
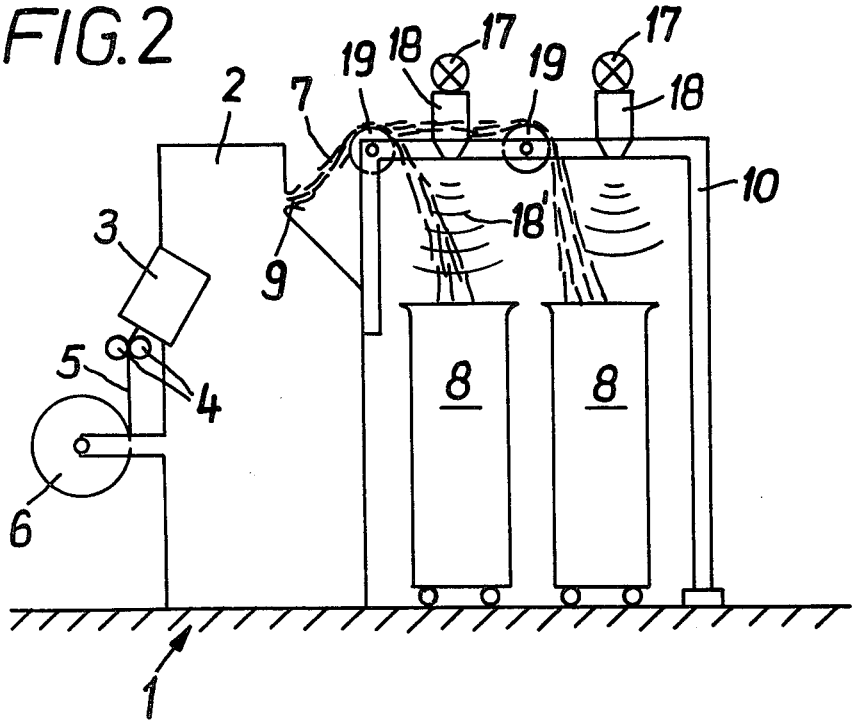
FIG. 2 is a view similar to that of FIG. 1 of an open-end spinning machine with ultrasonic transmitting-/receiving units associated with the supply containers according to a second embodiment of the invention.

In the embodiment shown in FIG. 2, each canister has associated with it an ultrasonic transmitting/receiving unit 18. In the housing of the ultrasonic unit 18 there are arranged adjacently an ultrasonic transmitter and an ultrasonic receiver. The transmitter as well as the receiver are conventional items and are available commercially from, e.g. the Endress + Hauser GmbH + Co., D - 7867 Maulburg, F.R. of Germany, these elements being designated both as "Ecosonic U 3" by that corporation. The transmitter emits soundwaves 18' directed toward the contents of the canister. The reflected soundwaves are evaluated in the receiver of the ultrasonic unit 18. The evaluation method is conventional; see, e.g. Lubcke: "Akustische Tiefenmessung," published in Archiv fur technisches Messen, Munic (Germany) and Oldenburg, volume 1935, part V 1124. When a maximum distance has been reached between the top surface of the canister contents and the ultrasonic unit, the latter emits a switching pulse which lights up a signal light 17 assigned to the ultrasonic unit.

The ultrasonic units 18, as well as the guide rollers 19 associated with canisters 8 are held stationary in stand 10.

A particularly simple embodiment of the present invention can be provided if instead of the ultrasonic units 18, or even the weighing platforms 11, counters are used as the monitoring devices. These counters may be coupled, for example, with the guide rollers 19 or with the feed rollers for the spinning machine.

Advisably an indicator unit is again associated with the counters which is caused to light up by means of a switching pulse when a certain count value has been reached. In this case the length of the fiber material band indicated by means of the counter serves to determine the fill level of the canisters 8, it being assumed that every canister 8 initially holds fiber material of the same length.

Figure 4:
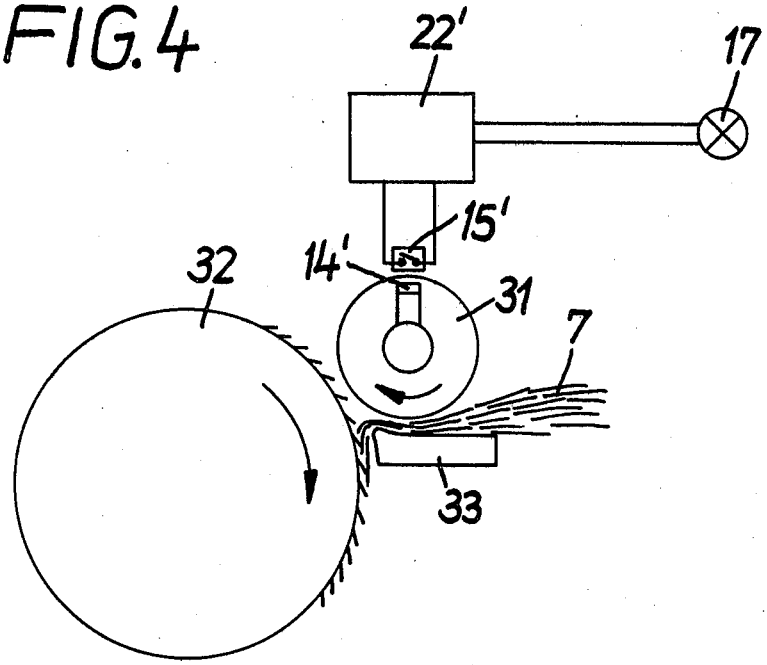
FIG. 4 shows in detail an intake roller and a break-up roller of an open-end spinning machine and a magnetic switch actuated by a magnet driven by the intake roller.

In an advantageous embodiment shown in FIG. 4 the feed roller 31 is forwarding the fiber material 7 to the break-up roller 32. A permanent magnet 14' is fastened to the shaft of the feed roller 31. Each revolution of the feed roller a magnetic switch 15' is actuated by the magnet 14' whereby the respective switching circuit of a comparison unit 22' is closed and an pulse is given to a counter within the comparison unit. The pulses are counted and compared with a predetermined number of pulses. When the predetermined number is reached the signal is lightened.

Figure 3:
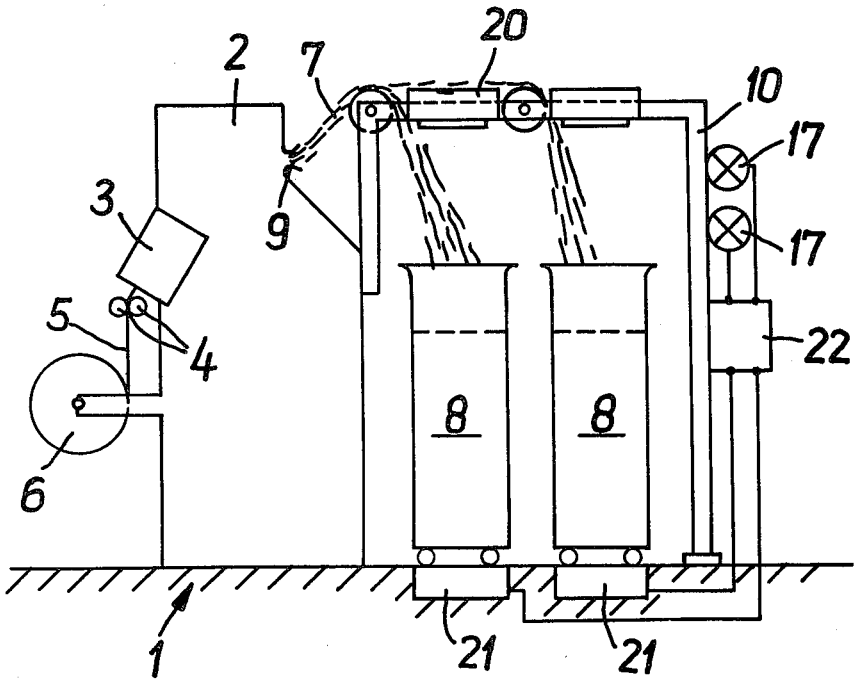
FIG. 3 is a view similar to that of FIG. 1 of an open-end spinning machine with transmitting units which emit radioactive radiation and receivers disposed opposite thereto with respect to the associated supply containers according to a third embodiment of the invention.

In another embodiment of the apparatus, shown in FIG. 3, above each canister 8 there is disposed a stationary transmitting unit 20 which emits radioactive radiation in the direction towards the open top of its associated canister 8. The transmitting unit has associated to it on the side opposite thereto with respect to the contents of the canister, i.e., in the present case below canister 8, a stationary receiver 21 which converts the received radioactive radiation into an analog measuring value. The principle of the respective measuring method is described by H. Maschner in "Automation und Rationalisierung in der Textilindustrie durch kernstrahlung" (1st part of the closing conference of the textile action of the bureau EURISOTOP at Evian-les-Bains, France, from May 8th to 10th, 1967), published by the "Information and Documentation" group of the bureau EURISOTOP.

On the way through the canister contents, the radioactive radiation is partially absorbed, i.e., the radiation intensity is reduced. The greater the mass of the fiber material 7 filling the canister, or the greater the fill level, the higher the radiation absorption. The measuring value formed in receiver 21 is fed to a comparison unit 22 shich compares it with an adjustable limit value. As soon as this limit value has been reached, a signal lamp 17 assigned to the canister and connected to the comparison unit lights up.

The bottom of canisters 8 advisably is made of a material which absorbs as little as possible of the radioactive radiation.

According to a modification of the embodiment shown in FIG. 3, the apparatus may also be designed so that the transmitting unit 20 is disposed below the associated canister 8 and the receiver 21 is consequently disposed above the canister.

Figure 5:
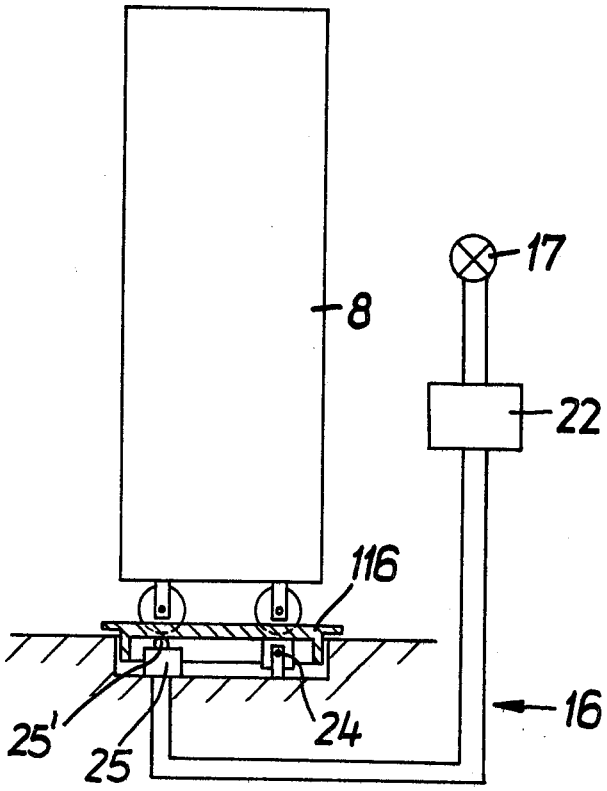
FIG. 5 shows an arrangement of a canister already shown in FIG. 1 but set on a platform pivoted on one axis and resting on a pressure force indicating switch box.

In FIG. 5 is shown another modified embodiment of the invention. The platform 116 is pivoted on an axis 24 at one side. At the other side the platform is resting on a pin 25' of a switch 25 which may operate according to the magnetic-elastic principle, controlling the signal light 17 via the comparing unit 22. The signal lamp 17 may be controlled by inductive sensors or by strain gages, too. All these measuring principles are described by H. Nelting and G. Thiele in "Elektronisches Messen nichtelektrischer Grossen. Grundlagen und Praxis", published by Philips Technische Bibliothek (Hamburg, F. R. of Germany), 1966, pages 323–326.

Figure 1A:
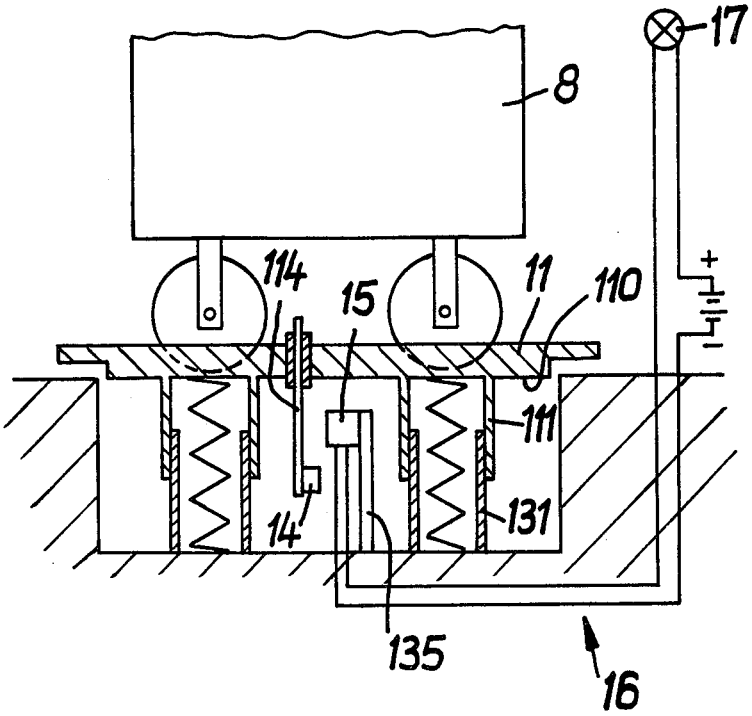
FIG. 1*a* shows in an enlarged scale and more detailed the arrangement of the weighing unit and the associated switch.
Figure 1B:
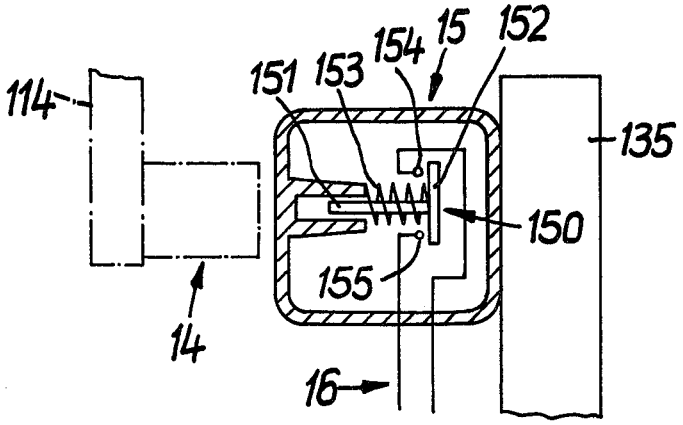
FIG. 1*b* shows the principle structure of the switch associated to the weighing unit.
Figure 6:
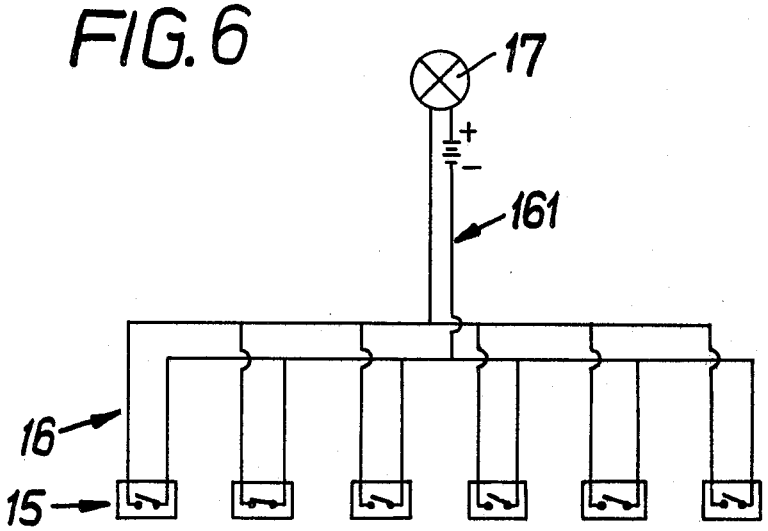
FIG. 6 shows a principal layout of a plurality of switches of monitoring devices combined in a group with a common indicator unit.

The prescribed monitoring devices may be combined into groups, with each group having a common indicator unit. For instance the different switching circuits 16 of the respective switches 15 of the embodiment shown in FIGS. 1, 1*a* and 1*b* may be combined to one common circuit path 161, as shown in FIG. 6. If only one switch 15 is closed the signal lamp 17 lights up.

It will be understood that the above description of the present invention is susceptible to various modifications, changes and adaptations, and the same are intended to be comprehended within the meaning and range of equivalents of the appended claims.

What is claimed is:

1. In the processing of a band of fiber material at a plurality of processing locations in a textile machine which operates while periodically being unattended and receives the fiber material band to be processed from supply containers, the improvement comprising continuously determining the fill level of the fiber material in each of the supply containers by means of an automatic monitoring device, and producing an output signal when the monitoring device indicates that the fill level of the fiber material in the container has reached a predetermined lower limit value which is at least equal to the fill level required for the subsequent attendance free period of operation to thereby permit maintenance of a sufficient supply of fiber material to the machine during said period of operation.

2. A method as defined in claim 1 wherein the machine is an open-end spinning machine composed of a plurality of spinning locations each arranged to permit automatic exchange of bobbins and automatic corrections of yarn breaks.

3. A method as defined in claim 1 wherein said step of monitoring comprises measuring the length of fiber material removed from the supply container.

4. A method as defined in claim 1 wherein said step of monitoring comprises measuring the reduction in weight produced by the removal of fiber material from the supply container.

5. A method as defined in claim 1 wherein said step of monitoring comprises measuring the reduction in fill level of the fiber material in the container.

6. In a textile machine which operates while periodically being unattached for processing a band of textile material and including at least one supply container filled with the band of textile material and means conducting the material from the container for processing, the improvement comprising means for continuously determining the extent to which said supply container is filled with fiber material, said means including automatic monitoring means connected for monitoring the quantity of fiber material in said container, and indicator means connected to said monitoring means for producing an output signal when the monitoring performed by said monitoring means indicates that the quantity of fiber material in said container has reached a predetermined lower limit value; said value being at least equal to the fill level required for the subsequent attendance free period of operation.

7. An arrangement as defined in claim 6 wherein said monitoring means comprise an actual value/limit value comparison unit having an adjustable limit value determining the lower limit value and connected to activate said indicator means when the quantity of fiber material in said container reaches the lower limit value.

8. An arrangement as defined in claim 7 wherein said textile machine is an open-end spinning machine having a plurality of yarn spinning locations and there are a plurality of supply containers with at least one supply container being associated with each spinning location.

9. An arrangement as defined in claim 6 wherein said monitoring means comprises a counter having an input member connected to be driven by the movement of the fiber material from said container at a rate proportional to the rate of such fiber material movement and to advance said counter at a rate proportional to such fiber material movement rate.

10. An arrangement as defined in claim 6 wherein said monitoring means comprises a weighing unit having a vertically movable weighing platform supporting said supply/container.

11. An arrangement as defined in claim 6 wherein there are a plurality of said containers and a plurality of monitoring means each connected for monitoring the fiber material quantity in a respective container, and said indicator means constitutes a common indicator unit connected to all of said monitoring means.

12. In a textile machine which operates while periodically being unattended for processing a band of textile material and including at least one supply container filled with the band of textile material and means conducting the material from the container for processing, the improvement comprising means for continuously determining the extent to which said supply container is filled with fiber material, said means including automatic monitoring means comprising a weighing unit having a vertically movable weighing platform supporting said supply container, said monitoring means connected for monitoring the quantity of fiber material in said container, and indicator means comprising a variable height control switch connected to said monitoring means to be actuated by a magnet fastened to said weighing platform for producing an output signal when the monitoring performed by said monitoring means indicates that the quantity of fiber material in said container has reached a predetermined lower limit value.

13. In a textile machine which operates while periodically being unattended for processing a band of textile material and including at least one supply container filled with the band of textile material and means conducting the material from the container for processing, the improvement comprising means for continuously determining the extent to which said supply container is filled with fiber material, said means including automatic monitoring means comprising an ultrasonic transmitting receiving unit connected for monitoring the quantity of fiber material in said container, and indicator means connected to said monitoring means for producing an output signal when the monitoring performed by said monitoring means indicates that the quantity of fiber material in said container has reached a predetermined lower limit value.

14. In a textile machine which operates while periodically being unattended for processing a band of textile material and including at least one supply container filled with the band of textile material and means conducting the material from the container for processing, the improvement comprising means for continuously determining the extent to which said supply container is filled with fiber material, said means including automatic monitoring means comprising an inductive sensor connected for monitoring the quantity of fiber material in said container, and indicator means connected to said monitoring means for producing an output signal when the monitoring performed by said monitoring means indicates that the quantity of fiber material in said container has reached a predetermined lower limit value.

15. In a textile machine which operates while periodically being unattended for processing a band of textile material and including at least one supply container filled with the band of textile material and means conducting the material from the container for processing, the improvement comprising means for continuously determining the extent to which said supply container is filled with fiber material, said means including automatic monitoring means comprising a pressure measuring box which operates according to the magnetic-elastic principle which is disposed in the intake area of said supply container and is connected for monitoring the quantity of fiber material in said container, and indicator means connected to said monitoring means for producing an output signal when the monitoring means indicates that the quantity of fiber material in said container has reached a predetermined lower limit value.

16. In a textile machine which operates while periodically being unattended for processing a band of textile material and including at least one supply container filled with the band of textile material and means conducting the material from the container for processing, the improvement comprising means for continuously determining the extent to which said supply container is filled with fiber material, said means including automatic monitoring means connected for monitoring the quantity of fiber material in said container, and indicator means connected to said monitoring means for producing an output signal when the monitoring performed by said monitoring means indicates that the quantity of fiber material in said container has reached a predetermined lower limit value; and wherein said monitoring means comprises a transmitting unit disposed to one side of said container for emitting radioactive radiation toward the interior of said container, a radioactive radiation receiver disposed to the side of said container opposite to said one side for receiving radiation which has been emitted by said transmitting unit and passed through the fiber material in said container and for producing a monitoring signal proportional to the intensity of the radiation it receives, which is inversely proportional to the quantity of fiber material in said container, and a comparison unit connected between said receiver and said indicator means for receiving the monitoring signal from said receiver and causing said indicator means to produce its said output signal.

* * * * *